US006779203B1

(12) United States Patent
Quillen

(10) Patent No.: US 6,779,203 B1
(45) Date of Patent: Aug. 24, 2004

(54) EMERGENCY TOILET SHUTOFF ASSEMBLY

(76) Inventor: William T. Quillen, 657 Sabal Lake Dr., #109, Longwood, FL (US) 32779

( * ) Notice: Subject to any disclaimer, the term of this patent is extended or adjusted under 35 U.S.C. 154(b) by 0 days.

(21) Appl. No.: 10/317,283

(22) Filed: Dec. 13, 2002

(51) Int. Cl.[7] ..... E03D 1/00
(52) U.S. Cl. ..... 4/353; 137/390
(58) Field of Search ..... 4/353, 415; 137/390, 137/441

(56) References Cited

U.S. PATENT DOCUMENTS

| | | | | |
|---|---|---|---|---|
| 2,729,827 A | | 1/1956 | Morita | |
| 4,204,285 A | | 5/1980 | Pak | |
| 4,402,093 A | | 9/1983 | Luker et al. | |
| 4,980,932 A | * | 1/1991 | Stemples | 4/415 |
| 5,062,166 A | | 11/1991 | Krenecki | |
| D360,932 S | | 8/1995 | Walter et al. | |
| 5,708,991 A | * | 1/1998 | DeMarco | 4/415 |
| 5,715,860 A | * | 2/1998 | Horad | 4/415 X |
| 6,178,569 B1 | | 1/2001 | Quintana | |

* cited by examiner

*Primary Examiner*—Robert M. Fetsuga

(57) ABSTRACT

An emergency toilet shutoff assembly for shutting off flow of water into the tank of a toilet. The emergency toilet shutoff assembly includes a toilet assembly including a tank having side walls, and also including a float support member being disposed in the tank, and further including a float member being supported upon the float support member, and also including a pair of water conduits being disposed in the tank for filling the tank with water; and also includes a valve assembly being connected to the water conduits for shutting off flow of water into the tank

2 Claims, 3 Drawing Sheets

EMERGENCY TOILET SHUTOFF ASSEMBLY

BACKGROUND OF THE INVENTION

1. Field of the Invention

The present invention relates to toilet tank shutoff valves and more particularly pertains to a new emergency toilet shutoff assembly for shutting off flow of water into the tank of a toilet.

2. Description of the Prior Art

The use of toilet tank shutoff valves is known in the prior art. More specifically, toilet tank shutoff valves heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,204,285; 6,178,569; 4,402,093; 2,729,827; 5,062,166; and U.S. Pat. No. Des. 360,932.

While these devices fulfill their respective, particular objectives and requirements, the aforementioned patents do not disclose a new emergency toilet shutoff assembly. The prior art discloses shutoff valves at the water source to prevent water from flowing into the tank of the toilet.

SUMMARY OF THE INVENTION

The general purpose of the present invention, which will be described subsequently in greater detail, is to provide a new emergency toilet shutoff assembly which has many of the advantages of the toilet tank shutoff valves mentioned heretofore and many novel features that result in a new emergency toilet shutoff assembly which is not anticipated, rendered obvious, suggested, or even implied by any of the prior art toilet tank shutoff valves, either alone or in any combination thereof. The present invention includes a toilet assembly including a tank having side walls, and also including a float support member being disposed in the tank, and further including a float member being supported upon the float support member, and also including a pair of water conduits being disposed in the tank for filling the tank with water; and also includes a valve assembly being connected to the water conduits for shutting off flow of water into the tank. None of the prior art includes the combination of the elements of the present invention.

There has thus been outlined, rather broadly, the more important features of the emergency toilet shutoff assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new emergency toilet shutoff assembly which has many of the advantages of the toilet tank shutoff valves mentioned heretofore and many novel features that result in a new emergency toilet shutoff assembly which is not anticipated, rendered obvious, suggested, or even implied by any of the prior art toilet tank shutoff valves, either alone or in any combination thereof.

Still another object of the present invention is to provide a new emergency toilet shutoff assembly for shutting off flow of water into the tank of a toilet.

Still yet another object of the present invention is to provide a new emergency toilet shutoff assembly that is easy and convenient to install and operate.

Even still another object of the present invention is to provide a new emergency toilet shutoff assembly that is much more readily accessible and reachable that that of the prior art.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
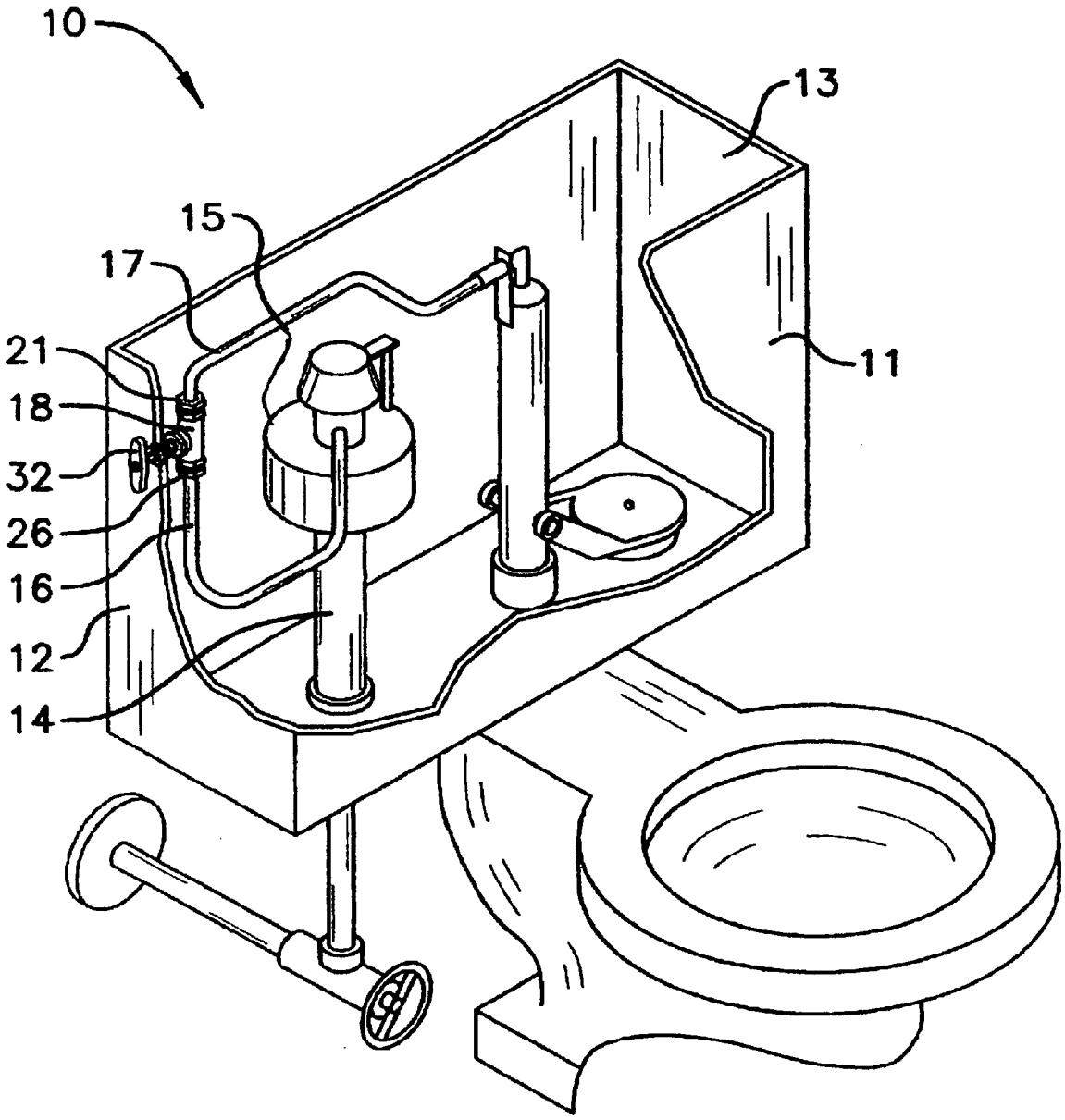
FIG. 1 is a cutaway perspective view of a new emergency toilet shutoff assembly according to the present invention.
Figure 2:
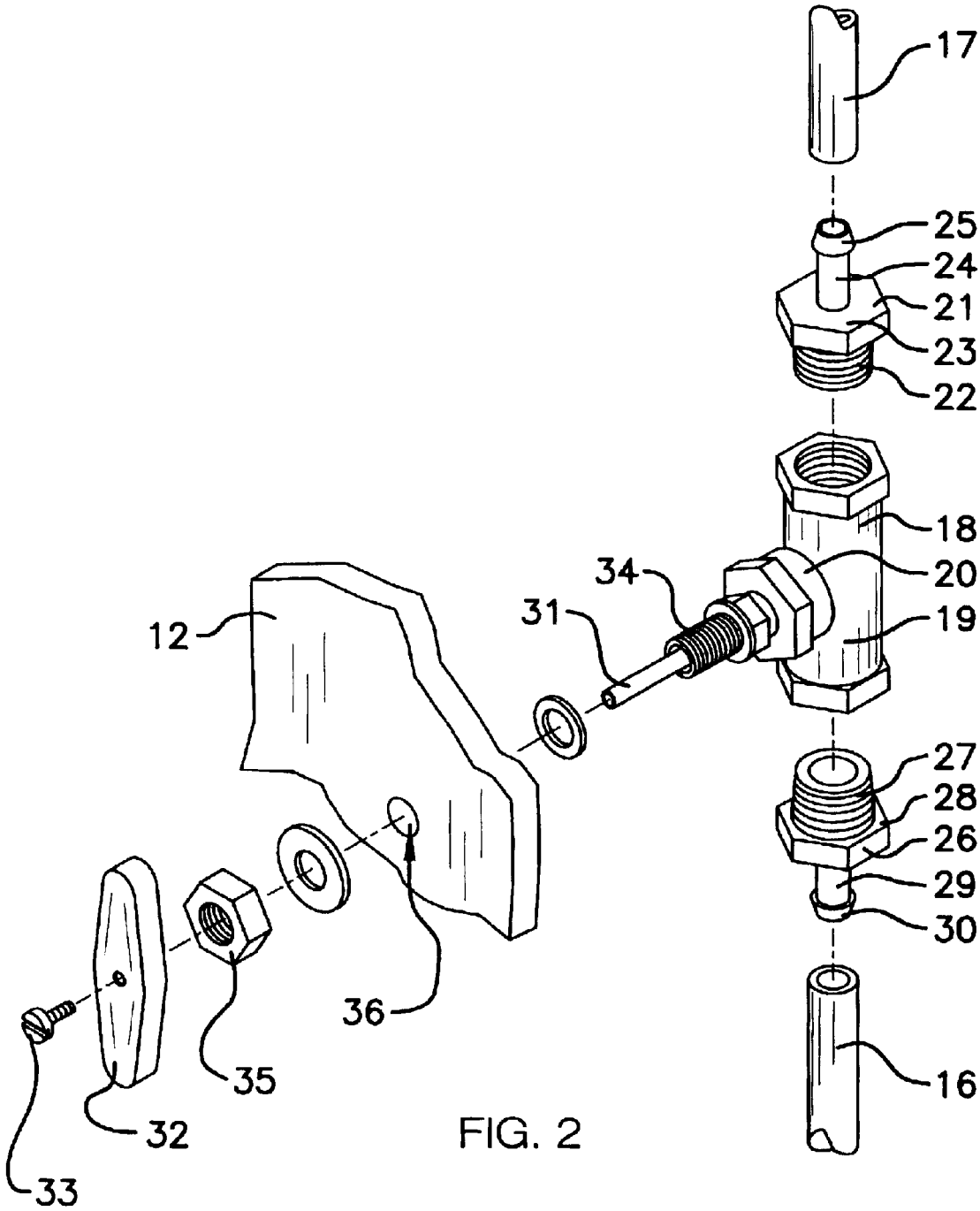
FIG. 2 is an exploded perspective view of the present invention.
Figure 3:
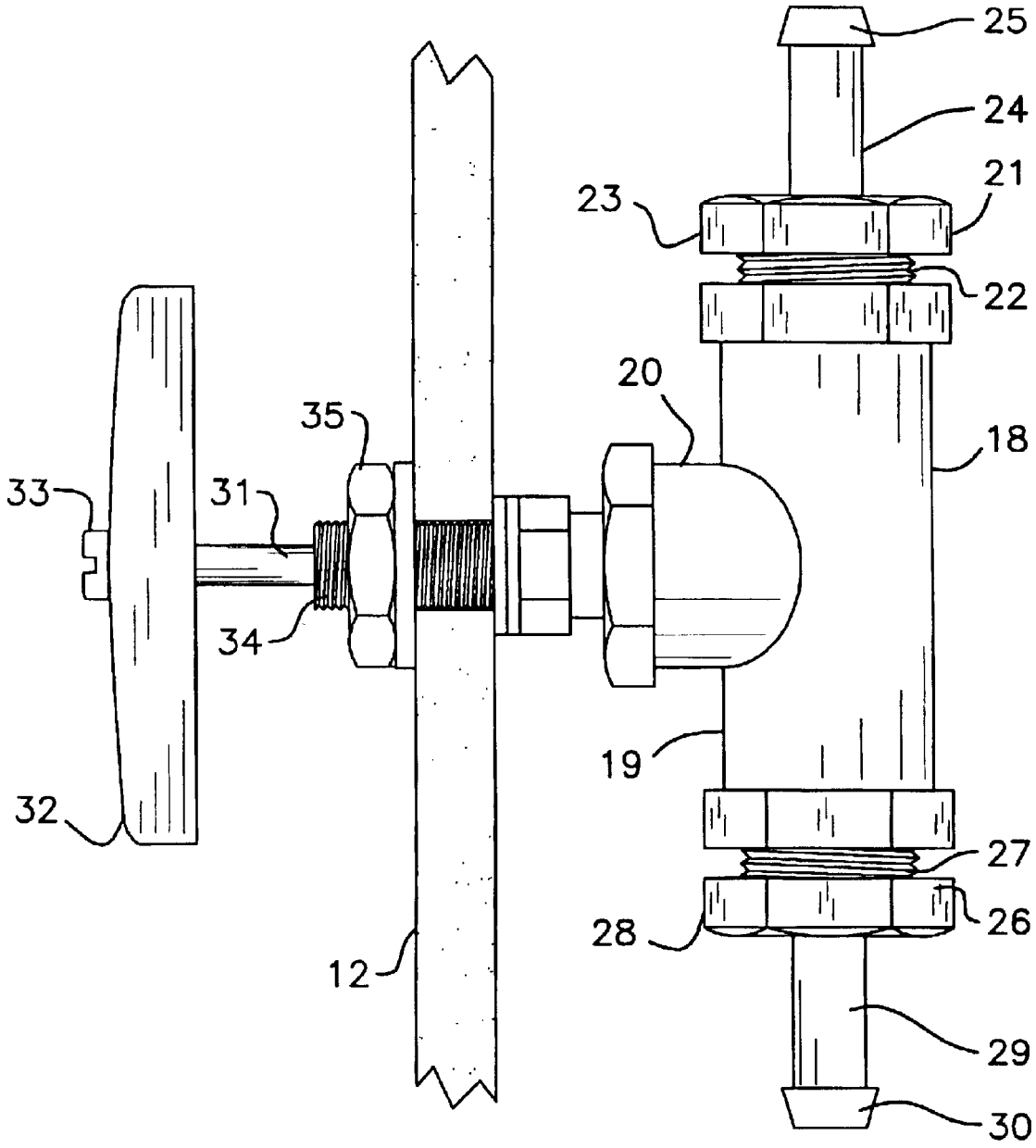
FIG. 3 is a side elevational view of the present invention.

With reference now to the drawings, and in particular to FIGS. 1 through 3 thereof, a new emergency toilet shutoff assembly embodying the principles and concepts of the present invention and generally designated by the reference numeral 10 will be described.

As best illustrated in FIGS. 1 through 3, the emergency toilet shutoff assembly 10 generally comprises a toilet assembly including a tank 11 having side walls 12,13, and also including a tank water-fill tube 14 being conventionally disposed in the tank 11, and further including a float member 15 being conventionally supported upon the tank water-fill tube 14, and also including a pair of water conduits 16,17 being conventionally disposed in the tank 11 with one of the side walls 12 of the tank 11 having a hole 36 being disposed therethrough.

A valve assembly is conventionally connected to the water conduits 16,17 for shutting off flow of water into the tank 11. The valve assembly includes a tubular T-shaped valve body 18 having a main portion 19 and a branch portion 20, and also includes connectors 21,26 interconnecting the tubular T-shaped valve body 18 to the water conduits 16,17, and further includes a valve member 31 being extended through the branch portion 20 for closing a passageway through the main portion 19 to prevent flow of water into the tank 11, and also includes a handle 32 being attached to the valve member 31, and further includes a valve support assembly being mounted to one of the side walls 12 of the tank 11. Each of the connectors 21,26 includes an externally-threaded tubular end portion 22,27 which is threaded into an open end of the main portion 19 of the tubular T-shaped valve body 18, and also includes an intermediate multi-sided nut portion 23,28 for threading the externally-threaded tubular end portion 22,27 into the main portion 19 of the tubular T-shaped valve body 18, and further includes a tubular stem portion 24,29 being integrally connected to the intermediate multi-sided nut portion 23,28 and extending outwardly therefrom and being insertable in an end of a respective water conduit 16,17. The tubular stem portion 24,29 of each connector 21,26 has a mushroom-shaped outer end 25,30 for securely engaging in a respective water conduit 16,17. The valve member 31 has an outer end portion which is extended through the hole 36 of the side wall 12 of the tank 11. The handle 32 is fastened with a fastening member 33 to the outer end portion of the valve member 31 and is disposed outside of the tank 11. The valve support assembly includes an externally threaded sleeve 34 being conventionally disposed about a portion of the valve member 31, and also has an end portion which is threaded into an end of the branch portion 20 of the tubular T-shaped valve body 18, and further is disposed through the hole 36 of the side wall 12 of the tank 11; and also includes a fastener 35 for fastening the externally threaded sleeve 34 to the side wall 12 of the tank 11.

In use, the user opens the passageway through the main portion 19 of the tubular T-shaped valve body 18 to allow water to pass into the tank 11 through the water conduits 16,17. If the user needs to prevent water from entering the tank 11, the user simply turns the handle 32 to move the valve member 31 into the passageway of the main portion 19 of the tubular T-shaped valve body 18 so that water cannot pass through the water conduits 16,17. Because of the location of the handle 32, the user is able to quickly shut off the flow of water into the tank II thus possibly preventing water damage.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the emergency toilet shutoff assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An emergency toilet shutoff assembly comprising:

a toilet assembly including a tank having side walls, and also including a tank water-fill tube being disposed in said tank, and further including a float member being supported upon said tank water-fill tube, and also including a pair of water conduits being disposed in said tank, one of said side walls of said tank having a hole being disposed therethrough; and a valve assembly being connected to said water conduits for shutting off flow of water into said tank, said valve assembly including a tubular T-shaped valve body having a main portion and a branch portion, and also includes connectors interconnecting said tubular T-shaped valve body to said water conduits, and further including a valve member being extended through said branch portion for closing a passageway through said main portion to prevent flow of water into said tank, and also including a handle being attached to said valve member, and further including a valve support assembly being mounted to one of said side walls of said tank, each of said connectors including an externally-threaded tubular end portion which is threaded into an open end of said main portion of said tubular T-shaped valve body, and also including an intermediate multi-sided nut portion for threading said externally-threaded tubular end portion into said main portion of said tubular T-shaped valve body, and further including a tubular stem portion being connected to said intermediate multi-sided nut portion and extending outwardly therefrom and being insertable in an end of a respective water conduit, said tubular stem portion of each said connector having a mushroom-shaped outer end for securely engaging in a respective said water conduit, said valve member having an outer end portion which is extended through said hole of said side wall of said tank, said handle being fastened with a fastening member to said outer end portion of said valve member and being disposed outside of said tank.

2. An emergency toilet shutoff assembly as described in claim 1, wherein said valve support assembly includes an externally threaded sleeve being disposed about a portion of said valve member, and also having an end portion which is threaded into an end of said branch portion of said tubular T-shaped valve body, and further being disposed through said hole of said side wall of said tank; and also includes a fastener for fastening said externally threaded sleeve to said side wall of said tank.

* * * * *